US005332113A

United States Patent [19]

Kusler, III et al.

[11] Patent Number: 5,332,113

[45] Date of Patent: Jul. 26, 1994

[54] CAP ASSEMBLY

[75] Inventor: John E. Kusler, III, Newburyport, Mass., Leonard W. Cooke, Newton, MA.

[73] Assignee: Elan Pharmaceutical Research Corporation, Gainesville, Ga.

[21] Appl. No.: 758,364

[22] Filed: Sep. 10, 1991

Related U.S. Application Data

[63] Continuation of Ser. No. 443,920, Nov. 30, 1989, abandoned.

[51] Int. Cl.[5] ..... B65D 41/32

[52] U.S. Cl. ..... 215/249; 215/232; 215/247; 220/256; 604/415

[58] Field of Search ..... 215/204, 232, 247, 249, 215/277; 220/256, 257, 258, 277; 383/67, 80, 202, 906; 604/408, 411, 415

[56] References Cited

U.S. PATENT DOCUMENTS

| | | | |
|---|---|---|---|
| 2,969,158 | 3/1959 | Baumann . | |
| 3,047,178 | 7/1962 | Poitras et al. | 215/249 X |
| 3,067,898 | 5/1959 | Reimann . | |
| 3,088,615 | 5/1963 | Mumford et al. | 215/249 |
| 3,215,299 | 11/1965 | Coanda et al. . | |
| 3,904,059 | 9/1975 | Bellamn, Jr. et al. | 215/247 |
| 3,923,062 | 12/1975 | St. Amand | 128/272 |
| 4,204,604 | 5/1980 | Morin et al. | 215/249 X |
| 4,519,513 | 5/1985 | Weiler et al. | 215/247 X |

*Primary Examiner*—Allan W. Shoap
*Assistant Examiner*—Nova Stucker
*Attorney, Agent, or Firm*—Marla J. Church

[57] ABSTRACT

A cap assembly for an enteral feeding container having an inner and outer cap, The inner cap has an upper end forming a tray with an inner peripheral lip and an outer peripheral lip, A flexible inner membrane covers the inner side of the tray of the inner cap to form a seal between the neck of the container and the tray. An outer membrane is placed over the outer side of the tray to form a sealed chamber, A cavity containing an appropriate disinfectant is centrally formed in the tray for receiving an enteral feeding tube spike when the outer membrane is removed, Access to the cavity is achieved by first removing the outer cap, then stripping away the outer membrane.

15 Claims, 1 Drawing Sheet

CAP ASSEMBLY

This is a continuation of copending application Ser. No. 07,443,920 filed on Nov. 30, 1989 abandoned.

SUBJECT MATTER OF INVENTION

The present invention relates to a cap assembly designed primarily for an enteral feeding container.

BACKGROUND OF INVENTION

The administration of enteral feeding formulas to patients and under non-hospital or medical supervision requires systems that are relatively fail proof and easy to administer by the lay public. During administration it is particularly desirable to maintain sterility of the formula throughout the delivery process. Heretofore, many systems have been developed which require care in wiping the end of the enteral feeding container with an appropriate cleansing solution prior to piercing the container for administration of the formula. Although such systems are simple to use for trained personnel, the systems may be inappropriately handled by other than trained personnel. This is of particular importance with the current trend of shortened hospital stays and increased home care which frequently result in untrained personnel assuming the responsibility of administering enteral feeding products to the patient. In addition, there is an ongoing need to improve enteral feeding containers and cap assemblies for use by trained personnel. While such trained personnel will ordinarily be fully familiar with procedures for applying disinfectants, time pressures and distractions may lead to errors or omissions during administration.

To date, a number of systems have been developed which attempt to provide sealed closure systems for the disposition of a variety of solutions especially parenteral solutions. Exemplary of the available closure mechanisms for parenteral solution equipment and similar systems, are those illustrated in Coanda et al, U.S. Pat. No. 3,215,299; Reimann, U.S. Pat. No. 3,067,898; Baumann, U.S. Pat. No. 2,969,158; and St. Amand, U.S. Pat. No. 3,923,062.

The Coanda reference for example, discloses a parental solution container having a cap with a frangible diaphragm situated within a centrally located tube. The Reimann reference shows a parental solution system having inner and outer cap members wherein a removable metal disk is provided which, when removed, exposes an inner rubber disk. The Baumann reference uses five components including a stopper to seal the open end of the unit. So far, as understood, these and other references do not provide a simply formed sealed chamber having a disinfectant added thereto which, when opened, is adapted to expose a means for receiving an enteral tube spike.

SUMMARY OF INVENTION

It is an object of the present invention to provide an improved means and method for capping the opening of an enteral feeding container.

A further object of the present invention is to provide an improved cap assembly for an enteral feeding container having a closed chamber containing a disinfectant.

A further object of the present invention is to provide an improved means for sealing the cap assembly to the opening of an enteral feeding container.

A further object of the present invention is to provide a cap assembly having a chamber containing disinfectant in which means for piercing the cap to access the enteral feeding formula is provided.

A further object of the present invention is to provide an improved enteral feeding cap assembly that is simple to manufacture, assemble, sterilize and use.

And yet a further object of the present invention is to provide an improved means and method for dispensing an enteral feeding fluid without substantial likelihood of contaminating the fluid during delivery.

The foregoing objects and advantages of the present invention are achieved with a cap assembly having an inner and outer cap in which the inner cap forms a sealed chamber containing a disinfectant and a means for sealing the cap assembly to the container neck. The sealed chamber includes a membrane adapted to be at least partially removed to expose an enteral tube spike receiving means.

BRIEF DESCRIPTION OF DRAWINGS

The foregoing objects and advantages of the present invention will be more clearly understood when considered in connection with the accompanying drawings in which.

DETAILED DESCRIPTION OF PREFERRED EMBODIMENT

Figure 1:
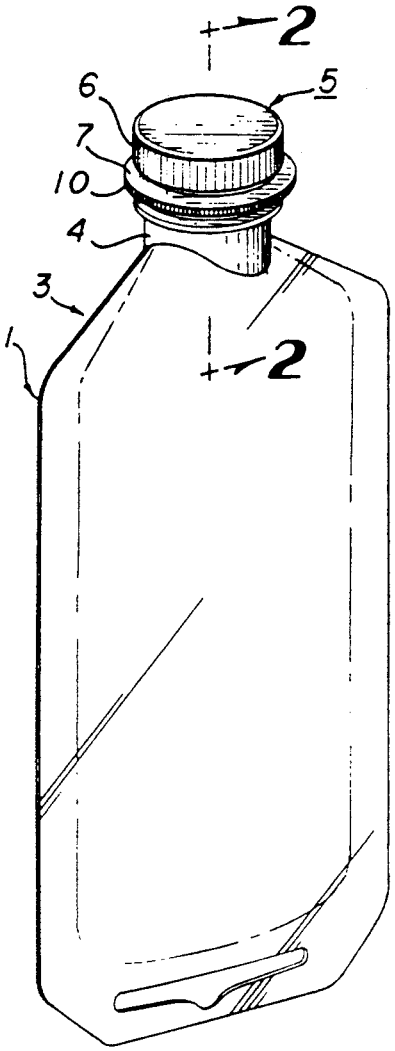
FIG. 1 is a perspective view of a preferred embodiment of the invention illustrating the cap assembly on an enteral feeding container.
Figure 2:
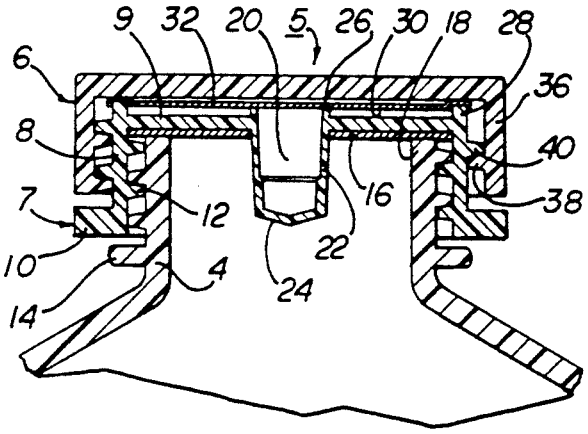
FIG. 2 is a fragmentary cross-sectional view taken substantially along the line 2—2 of FIG. 1.
Figure 3:
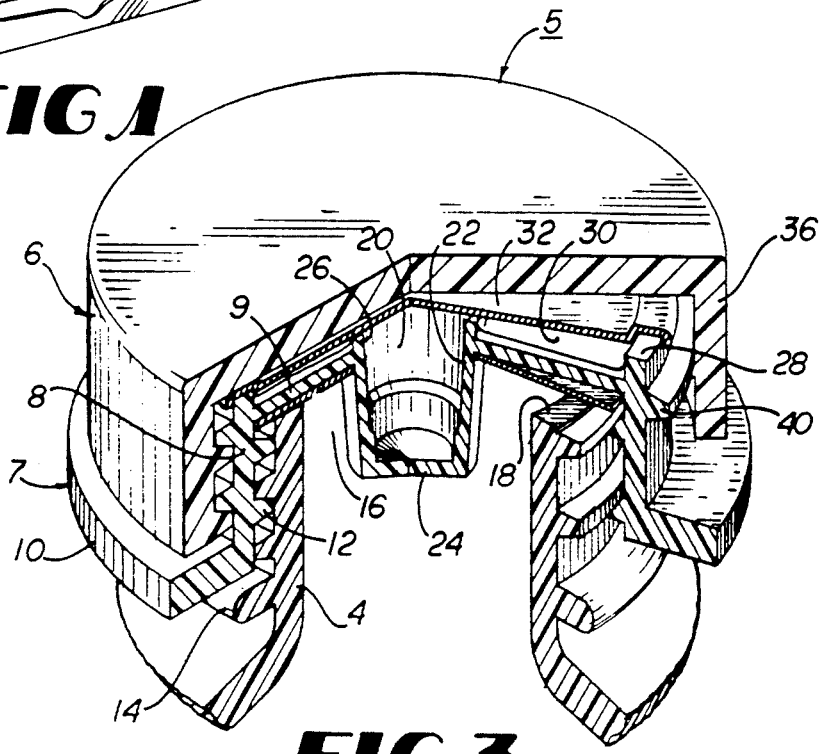
FIG. 3 is a fragmentary segmented perspective view of the cap assembly and a portion of the enteral feeding container.

The preferred embodiment of this invention is illustrated in FIG. 1 in connection with an enteral feeding container 1. It will be understood that the enteral feeding container 1 shown in FIG. 1, which is adapted to collapse as the enteral feeding formula (not shown) drains from within the container, is for illustrative purposes only. Cap assembly 5 of the present invention can be adapted for use on any conventional enteral feeding container either collapsible as shown in FIG. 1 or non-collapsible , for example , those made of formed plastic. To deliver the formula, the container of FIG. 1 is normally inverted from the position shown therein. An enlarged slot 2 is provided at the bottom of the container 1 to support it in an inverted position from a conventional IV support frame ( not shown ) . The upper end 3 of the container may have a variety of shapes, but is illustrated in FIG. 1 as being tapered to a narrow annular neck 4. Neck 4 is externally threaded at its open end.

The cap assembly 5 consists primarily of an outer cap 6 and an inner cap 7. The inner cap 7 is formed with an annular sidewall 8 depending from annular tray 9. The lower end of the inner cap sidewall 8 terminates in an outwardly extending radial flange 10. If desired, the outer surface of the radial flange 10 may be appropriately knurled. The inner surface of sidewall 8 is formed with internal threads 12 that interengage the external threads on the neck 4 to secure the inner cap 7 over the neck 4 of the container. Flange 14 formed on the outer surface of the neck 4 provides a stop for threading interengagement of the inner cap 7 with the neck 4. When in its normal fully closed position, the inner cap 7 fits tightly on the open end of the neck 4.

The tray 9 of the inner cap 8 is lined on its inner side with a moisture and oxygen barrier membrane referred to as the inner membrane 16 which is preferably an aluminum and polymer laminated foil. The inner membrane 16 is positioned between the upper end 18 of the neck 4 and tray 9. Each side of the aluminum and polymer laminated foil is coated with polymer which when melted can be fused to the periphery of tray 9 and the upper end 18 of the neck 4 to form a seal. The polymer is preferably polypropylene, polyethylene, polyvinylchloride or any other polymer approved by the FDA for food product containers which will effect a seal between tray 9 and neck 4.

Axially positioned within the tray 9 is a cavity 20 that depends from the center of the tray. The cavity 20 is defined by an annular depending wall 22 towards its bottom 24. The bottom 24 of the cavity 20 is appropriately weakened to permit piercing by a spike of an enteral feeding tube system. An inner annular lip 26 defines the upper end of the cavity 20 and, with an annular outer lip 28 that defines the periphery of the tray, partially forms a closed chamber 30. The remaining side of the closed chamber 30 is formed by an outer oxygen and moisture barrier membrane 32, preferably in the form of a laminated polymer and aluminum foil similar to that used for the inner membrane 16 except that the polymer is coated on only one side of the foil. Outer membrane 32 is heat-sealed at its periphery to the upper edge of the annular lip 28.

The closed chamber formed by the outer membrane 32, tray 9, and outer lip 28 is disinfected prior to application of the outer membrane 32 by placing a drop of alcohol or any other conventionally accepted disinfectant or cleansing solution into cavity 20. Thus, after the outer membrane 32 is heat-sealed to the inner cap, the disinfectant is maintained in the chamber 30.

The outer cap 6 is formed with a depending sidewall 36 having internal threads 38. The threads 38 engage the external threads 40 on the outer surface of the inner cap sidewall 8. The height of the outer cap sidewall 36 is shorter than the height of the inner sidewall 8, thus preventing under-tightening of the outer cap.

During assembly, the container 1 is first filled with an appropriate enteral feeding formula and, thereafter, the inner cap 7 with the inner membrane 16 in place is appropriately tightened onto the neck 4 of the container 1. The inner cap 7 is tightened until the inner membrane 16 comes in contact with the upper end 18 of the neck in a tight seal. Container 1 with inner cap 7 in place is then exposed to radio frequency waves at a sufficient frequency and an appropriate length of time to heat the aluminum foil of inner membrane 16 which in turn melts the polymer present on each side of the aluminum foil and fuses the polymer to both the neck 4 of the container 1 and the under surface of tray 9. Thereafter, the partially assembled unit is heated in a retort to 250° F. for a sufficient period of time to ensure sterilization of the enteral feeding solution. Upon completion of the retort process, the sterilized unit is allowed to cool , then a small quantity of a disinfectant or cleansing solution such as alcohol is deposited into cavity 20. After deposition of said quantity of alcohol, or the like, within cavity 20, the outer membrane 32 is secured to the upper end of the inner cap sidewall 8 to form the closed chamber 30 by turning outer cap 6 down onto inner cap 7. The entire unit is then exposed to radio frequency waves at a selected frequency and an appropriate length of time to effect a seal between the polymer coated underside of the outer membrane 32 at the periphery and the top of the inner cap sidewall 8. The completed unit is then ready for shipping.

In use, the outer cap 6 is removed, and immediately before the enteral feeding formula is to be administered, the outer membrane 32 is stripped from the end of the inner cap 7. To facilitate stripping, any conventional means such as a tab may be provided on outer membrane 32 that when lifted projects beyond the periphery of the upper end 18 for ease in grasping the outer membrane 32 for removal. Promptly after removal of the outer laminated foil 32, the spike of an enteral feeding tube system is forced downwardly into the cavity 20 and through bottom 24. The unit is then ready for delivery of the contents of the container 1. In this process, the sterile conditions of the enteral feeding formula of the container are maintained until use without requiring the separate step of swabbing or applying disinfectants to the area where the spike of the enteral tube feeding system enters the container.

What is claimed is:

1. A cap assembly for an enteral feeding container comprising an inner cap, said inner cap including means forming a disinfected chamber having a tray forming a first wall of said chamber and an outer annular lip defining the outer perimeter of said tray and means within said chamber for receiving a spike of an enteral feeding tube assembly, means for securing said inner cap to said enteral feeding container, an outer cap, said outer cap having means for removably securing said outer cap over said chamber and means for removeably sealing said disinfected chamber, and means or at least partially opening said sealed chamber to expose said spike receiving means.

2. A cap assembly as set forth in claim 1 wherein said means for sealing said disinfected chamber includes an outer oxygen and moisture barrier membrane defining a second wall of said chamber, and said means for opening includes means for removably sealing Mid outer membrane to said annular lip.

3. A cap assembly as set forth in claim 1 wherein said means forming a chamber includes and an outer membrane removably secured at its periphery to said lip.

4. A cap assembly as set forth in claim 1 wherein said means within said chamber for receiving the spike comprises a cavity depending from said tray.

5. A cap assembly as set forth in claim 4 having an inner annular lip defining the open end of said cavity in said tray.

6. A cap assembly as set forth in claim 5 having a disinfecting medium positioned in said captivity.

7. A cap assembly as set forth in claim 6 wherein said means forming a chamber includes an outer oxygen and moisture barrier membrane removably secured at its periphery to said outer annular lip.

8. A cap assembly as set forth in claim 7 including an inner oxygen and moisture barrier membrane secured to said inner cap across the surface of said tray facing away from said chamber.

9. A cap assembly as set forth in claim 8 wherein said cavity is defined by an annular depending wall extending from said surface facing away from said chamber.

10. A cap assembly as set forth in claim 7 wherein said inner cap has an annular depending sidewall that is internally and externally threaded, and said outer cap has an annular depending sidewall that is internally threaded to engage the external threads on said inner cap sidewall, said internal threads on said inner cap adapted to engage threads on said enteral feeding container.

11. A cap assembly as set forth in claim 1 further comprising a pair of oxygen and moisture barrier membranes positioned on either side of said tray with one membrane spaced therefrom and partially defining said chamber.

12. A cap assembly as set forth in claim 11, wherein said inner cap is shaped to engage the neck of an enteral feeding container with the other of said membranes in facing relationship with the neck of said container.

13. A cap assembly as set forth in claim 1 wherein said securing means comprises an inner oxygen and moisture barrier membrane.

14. A cap assembly as set forth in claim 13 wherein said inner oxygen and moisture membrane comprises an aluminum and polymer laminated foil with a polymer layer adhered to each side of the aluminum foil, wherein said polymer is selected from the group consisting of polypropylene, polyethylene and polyvinylchloride.

15. A cap assembly for an enteral feeding container, said cap assembly comprising an outer cap and an inner cap said inner cap including an annular sidewall integrally formed with a tray closing one end of said annular sidewall, means for receiving an enteral feed tube delivery spike integrally associated with said tray and an inner oxygen and moisture barrier membrane comprising an aluminum and polymer laminated foil for sealing said inner cap to the enteral feeding container, said outer cap having a depending annular sidewall, means formed in part on each annular sidewall for removably interlocking said outer cap over said tray of said inner cap, an outer oxygen and moisture barrier membrane comprising an aluminum and polymer laminated foil positioned intermediate to said outer cap and tray, and means removably securing said foil to the periphery of said tray forming a closed chamber therebetween.

* * * * *